United States Patent [19]

Kukin

[11] Patent Number: 4,842,617

[45] Date of Patent: Jun. 27, 1989

[54] COMBUSTION CONTROL BY ADDITION OF MAGNESIUM COMPOUNDS OF PARTICULAR PARTICLE SIZES

[76] Inventor: Ira Kukin, 45 Edgemont Rd., West Orange, N.J. 07052

[21] Appl. No.: 83,161

[22] Filed: Aug. 10, 1987

[51] Int. Cl.[4] ..... C10L 1/32

[52] U.S. Cl. ..... 44/51; 44/67; 44/76; 431/3; 431/4

[58] Field of Search ..... 431/3, 4; 44/51, 4, 44/5, 2, DIG. 3, 67, 76

[56] References Cited

U.S. PATENT DOCUMENTS 2,845,338 7/1958 Ryznar et al. ..... 44/67

3,332,755 7/1967 Kukin ..... 44/67

3,837,820 9/1974 Kukin ..... 44/5

FOREIGN PATENT DOCUMENTS 0149994 8/1984 Japan ..... 44/67

*Primary Examiner*—William R. Dixon, Jr.
*Assistant Examiner*—Margaret B. Medley
*Attorney, Agent, or Firm*—James & Franklin

[57] ABSTRACT

By adding a specific blend of coarse and fine particles of a magnesium compound to a relatively low temperature zone of a furnace system noxious and undesirable emissions are greatly reduced and internal boiler conditions are greatly improved.

18 Claims, No Drawings

COMBUSTION CONTROL BY ADDITION OF MAGNESIUM COMPOUNDS OF PARTICULAR PARTICLE SIZES

The present invention relates to a method for improving fuel combustion in furnaces, thereby to greatly improve stack emission problems and to minimize boiler fouling.

There are two general areas where fuel combustion presents problems. One general area involves the nature and amount of chemicals which are discharged into the environment. The substances emitted are often corrosive or otherwise damaging to any surfaces on which they fall. In many instances they are harmful to human or plant life, and in many instances they contribute to the formation of smog. These problems are today very generally recognized as quite serious, and strenuous efforts are being made to reduce the environmental pollution attendant upon combustion. The other general area, boiler fouling as a result of the formation of various substances in the boiler which coat the walls or the tubes of the boiler, constitutes a direct economic problem, since it reduces the efficiency of heat transfer and, when the build-up of materials becomes too great within the boiler, necessitates that the boiler be shut down from time to time for cleaning purposes, an obviously uneconomical procedure.

In general, different fuels present different problems. With sulphur-containing fuels, one of the major problems is the concentration of sulphur dioxide and sulphur trioxide in the stack gases. These compounds are extremely deleterious from a pollution point of view. When fuels contain vanadium in addition to sulphur, the production of undesired sulphur oxides is accentuated; the vanadium, probably in combination with the exposed iron on the tubes in the boiler, is able to catalyze the formation of undesirable sulphur oxides. Since both sulphur and vanadium are present in many of the commonly available industrial fuels, these problems are very pressing from a pollution control standpoint.

One standard approach to minimizing pollution problems is to add various substances to the fuel with a view to having those substances enter into chemical combination with the undesired products of combustion in order to render them less undesirable or more readily removable from the stack emissions. Many different substances have been proposed to this end, including magnesium, usually introduced into the fuel in the form of compounds such as oxides and hydroxides. It is the magnesium which is the active ingredient, the oxides and hydroxides being chosen as the addition media because they are more readily available and handleable than the active metal itself.

With these additives, as with other additives, problems often arise. In some instances the additives, while entering into the expected reactions, also enter into side reactions the products of which present their own individual problems, which sometimes outweigh the problems which are intended to be cured. Also, in some instances particular additives, especially when used in large quantities, cause such fouling of the interior of the boiler as to make them undesirable from an economic point of view. Moreover, all additives are costly, and if especially large amounts of a particular additive are required in order to produce a given improvement the cost may be prohibitive from a commercial point of view.

It has been proposed in the past that certain substances be added to the products of combustion at a relatively low temperature station. In general, insofar as magnesium-containing compounds such as oxides and any effect they may have in improving combustion and in particular in reducing $SO_3$ are concerned, this approach has been considered ineffective, because the magnesium compounds by themselves are too inert to produce the desired result. They are in solid form and must react with gaseous products. Reaction rates in such conditions are generally very low. It had therefore been thought that to use a magnesium compound such as magnesium oxide only in conjunction with cold end feed would require so much MgO that particulate matter would escape from the stack in tremendous volume, and a pollution problem would be created rather than eliminated.

In my earlier U.S. Pat. No. 3,837,820 of Sept. 24, 1974 entitled "Combustion Control By Additives Introduced in Both Hot and Cold Zones", I disclosed that a very effective combustion control could be achieved by burning the fuel in the presence of magnesium or manganese additives in minimal amounts, after which magnesium, usually in the form of a compound such as an oxide, is added to the combustion products at the zone in the furnace which has low temperature relative to the temperature of the combustion zone. That patent taught that several highly advantageous results were achieved thereby, namely, the ash is made less acidic, the hygroscopic nature of the flue gas particulates is reduced, acid smut is effectively eliminated, boiler fouling is reduced because lesser amounts of additive need be applied at the combustion station, and, most importantly, the $SO_3$ content of the fuel gas is very radically reduced by as much as 80%.

I have now discovered that even more improved combustion control is achieved by utilizing as the cold end additive, either alone or in conjunction with a furnace additive, a blend of magnesium compounds such as magnesium oxide which comprises a substantial amount of coarse compound in addition to a very fine grade of that compound; then the opacity of the gases emanating from the stacks is less pronounced than when one uses either the fine grade or the coarse grade by itself. Plume and acid smut are greatly reduced, the tendency of the air heaters to plug is reduced and corrosion of the air heaters is reduced, thus resulting in greater cleanliness, less need for cleaning and less costly maintenance or replacement of corroded parts. In addition, lesser quantities of this synthetic blend of different particle sizes can be employed, thus resulting in significant improvement in economy of operation.

It is the prime object of the present invention to improve the effects of fuel combustion, particularly with regard to emitting sulphur trioxide in the stack gases and improving the condition of the boilers where the combustion is carried out.

It is a further prime object of the present invention to achieve that improvement through the use of a minimal amount of additive, thereby reducing the expense of the fuel combustion improvement process.

It is another object of the present invention to provide a fuel combustion improvement process which is particularly adaptable for use in conjunction with commercially available fuels, and which can be carried out in existing combustion installations with a minimum of difficulty.

It is a further object of the present invention to provide a process for improving the effects of fuel combustion which inhibits the formation of slag in the boiler and which minimizes the emission of many acid substances in addition to sulphur trioxide.

The method in question can be used with many different types of fuel and many different types of furnaces. It may be used in oil-fired boilers such as those employed by utility companies, refineries and large industrial plants, with the additive feed to the relatively low temperature zone (hereinafter sometimes called cold-end feed) occurring at the economizer outlet, for example. The combustion of both residual fuel and crude oil is greatly improved in that manner. The process may also be used with coal-fired and waste gas-fired boilers with a cold end feed occurring at the uptakes, for example. The process is also applicable for use in steel mills burning waste gases, either alone or with Bunker C fuels, by refineries burning waste gas in boilers, and in refinery process heaters burning waste gas or waste gas in combination with Bunker C fuel. This list is not intended to be all-inclusive.

When the magnesium-containing substance is added to the combustion products at a relatively low temperature station, it reacts directly and catalytically with the $SO_3$ in the flue gas. It dramatically reduces acid particulates, acid condensation and dew point of the flue gas.

The cold zone treatment has been found to be more effective in controlling acid conditions than the standard oil treatment methods. One reason for this greater reactivity is that the cold zone additive does not have to first pass through the flame zone before combining with $SO_3$ in the colder zones of the boiler. In the flame oil dispersed additives, such as MgO or $MgO:Al_2O_3$, do not react with $SO_3$ at the high temperatures involved. At high boiler temperatures the sulfate complexes decompose, actually releasing $SO_3$. The dryer and less hygroscopic ash resulting from the cold-end feed reduces cold end corrosion and at the same time will often eliminate acid smut emission problems. Moreover, an improvement in the stack plume appearance will often result from cold-end feed, with the consequent elimination of nuisance and legal complaints, particularly when the plant is in a residential area.

To the accomplishment of the above, and to such other objects as may hereinafter appear, the present invention relates to a method of improving the effects of fuel combustion, as defined in the appended claims and as described in this specification.

In a typical boiler installation, such as the non-recirculating installation shown in FIG. 1 of my aforementioned U.S. Pat. No. 3,837,820 and the recirculating embodiment shown in FIG. 2 thereof, an appropriate fuel, such as fuel oil, coal or combustible gas, is introduced into the furnace in any appropriate manner as through burner guns in the case of fuel oil. Air, preferably heated, is supplied to the furnace in any appropriate manner to combine with the fuel. Combustion of the fuel takes place in the furnace, the portion of the heat energy provided by that combustion being transmitted to the tubes covering the furnace walls, thus converting the water in those tubes to steam. Combustion of the hot gas may be completed by means of the addition thereto of secondary heated air from a heated air duct, air being supplied to that duct from an air inlet by a blower, an air duct, an air preheater and other air ducts. The products of combustion then pass through the platen superheater and reheater, pendant superheater, and horizontal superheater. When the combustion products leave the horizontal superheater their temperature, which in the furnace was about 2,400°–2,800° F., has been reduced to 800°–900° F. The products of combustion then flow through an economizer which preheats the water entering the steam-producing tubes inside the furnace. The products of combustion then flow into the gas duct at a temperature of 650°–700° F. They then flow through an air heater which transfers the heat from the exiting gases to an air preheater. At this point the temperature of the products of combustion is approximately 300° F. The products of combustion then flow through precipitators where ash is removed from the stream of gas. The thus cleaned gas flows through a duct and induced draft fan into breeching and then out through the stack.

The conventional approach to minimize the problems presented by $SO_3$ and acid smut in the stack effluent is to introduce into the furnace a suitable quantity of a magnesium compound, such as magnesium oxide. This is done by mixing it with the fuel or by applying it to the coal before the latter is burned or by adding the substance to the furnace while combustion takes place. Such an additive has several effects. It reacts with the vanadium in the fuel to prevent high temperature corrosion and the formation of hard slag inside the furnace. It acts itself to coat the superheater tubes and thus insulate the products of combustion from the iron surfaces of those tubes. Since iron catalyzes the formation of $SO_3$ from $SO_2$, this results in a reduction in the formation of $SO_3$. In addition, the magnesium compound reacts with vanadium, thus reducing the amount of vanadium oxide which is formed, that vanadium oxide also tending to catalyze the formation of $SO_3$. For these purposes, the magnesium oxide can be added to the fuel in any suitable form, such for example as a premix with the fuel, as a liquid slurry added to the fuel, or as a powder injected into the furnace proper.

However, there is a limit to the amount of magnesium compound which can be provided at the high temperature combustion zone in the furnace. If too much such material is provided large amounts of ash will result; this ash will build up in and eventually block the furnace, requiring that it be shut down and cleaned. Moreover, the greater the amount of ash, the greater the amount of inorganic particulate matter emitted through the stack. In addition, the mechanism by which magnesium reduces the amount of $SO_3$ in the products of combustion involves the formation of magnesium sulphate. Magnesium sulphate decomposes at temperatures above 1,500° F., and since the temperatures in the furnace are well above that value the decomposition of magnesium sulphate undoes what the added magnesium initially accomplishes. Indeed, the nature of the reactions involving $SO_2$are such that the introduction of massive amounts of magnesium oxide into the hot end of the furnace may actually increase the production of $SO_3$ rather than decrease it.

The active component of the additive here under discussion is magnesium. However, the handling of that metal is not particularly convenient, nor is it commercially available in quantity at reasonable prices. Accordingly the preferred additives are compounds of magnesium, usually the oxides or hydroxides thereof because of their ready and economic availability and ease of handling.

Magnesium oxide, the magnesium compound of choice for economic and availability reasons, is commercially provided in two grades, the characteristics of which are set forth in the following Table I:

TABLE I

Properties of Light and Heavy MgO From Commercial Supplier

| | (A) Light, "Fine" MgO | (B) Heavy, "Coarse" MgO |
|---|---|---|
| Bulk Density, loose lb./ft.$^3$ (Kg/M$^3$) | 18 | 75 |
| Mean Particle Size, Microns | 5 | 10 |
| Surface area/gram, M$^2$ | 20 | Less than 1 M$^2$/gram |
| Activity index, seconds | 18 | 25 |
| Screen size: | | |
| (a) % passing minus 325 mesh | 99 | — |
| (b) % passing minus 200 mesh | — | 99 |
| or, | | |
| Screen size: | | |
| Mesh for passage of 99% of material (max. mesh) | 325 | 200 |

The light or "fine" MgO is often referred to in the trade as "soft" MgO, and the heavy or "coarse" MgO is often referred to in the trade as "hard" MgO. Also commercially available is MgO comprised of particles of virtually all sizes, with a mean particle size of less than 2 microns and a loose bulk density of about 30 lb./ft.$^3$ (Blend C).

While use of these commercially available magnesium oxides as cold end additives, either alone or in conjunction with magnesium and/or manganese additives in the furnace, has been efficacious for the purposes set forth, the degree of combustion improvement, particularly with respect to reduction in $SO_3$ and plume, still leaves room for improvement. That improvement can be attained, in accordance with the present invention, by utilizing a special blend of magnesium oxide particles consisting of both "hard" magnesium oxide and "soft" magnesium oxide in particular proportions. While the "hard" MgO has a bulk density of about 75 lb./ft.$^3$, the "soft" MgO has a bulk density of about 18 lb./ft.$^3$, and the commercially available blend of MgO's has a bulk density of about 30 lb./ft.$^3$, the MgO blend of the present invention has a bulk density of from 35 to 67 lb./ft.$^3$, with a bulk density of about 45 lb./ft.$^3$ being preferred. This blend consists of "hard" MgO in proportion by weight of 90%–30% and with "soft" MgO in proportions by weight of 10%–70%, with proportions of 66.6% "hard" and 33.3% "soft" preferred. The mean particle size of these blends ranges from 4 microns to 9 microns with a preferable particle size of from 5.5–8.5 microns. This is to be compared with the mean particle size of the available commercial blend, which is less than 2 microns. Use of this blend as a cold end additive consistently shows improved reduction of the $SO_3$ content in the flue gas exiting from the air heaters as compared to the commercially-available magnesium oxide, as shown in the following Examples 1–5 and the Tables II and III which follow.

EXAMPLE 1

A commercially available magnesium oxide, Blend C, was aspirated into the economizer outlet of the boiler at a temperature of 700° F. On a dry powder basis, 3.1 lbs. of magnesium oxide was injected for each 8,000 lbs. of fuel oil burned in the above boiler.

The $SO_3$ was reduced from 60 to 45 parts per million.

EXAMPLE 2

A synthetically prepared blend of magnesium oxide, Blend D, prepared by mixing 66.6% of heavy MgO with 33.3% of fine MgO, was aspirated into the economizer outlet of the boiler at a temperature of 700° F. On a dry powder basis, 3.1 lbs. of this blend of magnesium oxide was injected for each 8,000 lbs. of fuel oil burned in the above boiler.

The $SO_3$ was reduced from 60 to 35 parts per million.

EXAMPLE 3

The magnesium oxide powder, Blend D, was aspirated into the boiler chamber at the superheater inlet. On a dry basis, 3.1 lbs. of magnesium oxide was injected for each 8,000 lbs. of fuel oil burned in the above boiler.

The $SO_3$ was reduced from 60 to 40 parts per million.

EXAMPLE 4

The magnesium oxide powder, Blend D, was aspirated into the boiler chamber at the superheater inlet at 1.5 lbs. per 8,000 lbs. of fuel oil burned. At the same time, this same magnesium oxide powder, Blend D, was aspirated into the economizer inlet at a rate of 1.6 lbs. of magnesium oxide for each 8,000 lbs. of fuel oil burned.

The $SO_3$ was reduced from 60 to 28 parts per million.

EXAMPLE 5

The magnesium oxide powder, Blend D, was added as a slurry into the fuel oil burned in the boiler. The MgO added provided 1.5 lbs. of MgO for each 8,000 lbs. of fuel oil. At the same time, the magnesium oxide powder, Blend D, was added to the economizer outlet to supply 2.5 lbs. of MgO for each 8,000 lbs. of fuel oil in the same boiler.

The $SO_3$ was reduced from 60 to 21 parts per million. There also was a significant diminution of the plume from the flue gases leaving the boiler stack.

TABLE II

Cold End Feed
Fuel: Bunker C of 225 ppm V; 2.05% S and 0.085% Ash
Injection at: Economizer Outlet

| Example | Agent of | Sulfur Trioxide in flue gas (parts per million | Acidity of Ash Deposits on Air Heater Outlet | Condition of Air Heaters in test section | Appearance of Stack | Total lbs. of Additive (on dry basis) per 8,000 lbs. of fuel-equal to lbs. Additive/1000 gals. Fuel |
|---|---|---|---|---|---|---|
| — | None | 60 | 1.9 | Badly Corroded | Distinct blue plume | — |
| 1 | (C) | 45 | 3.0 | Significant Corrosion | Slight blue plume, but reduced in intensitiy | 3.1 |
| 2 | (D) | 35 | 3.5 | Slight Corrosion | Slight blue-grey | 3.1 |

TABLE II-continued

| Example | Agent of | Sulfur Trioxide in flue gas (parts per million | Acidity of Ash Deposits on Air Heater Outlet | Condition of Air Heaters in test section | Appearance of Stack | Total lbs. of Additive (on dry basis) per 8,000 lbs. of fuel-equal to lbs. Additive/1000 gals. Fuel |
|---|---|---|---|---|---|---|
| | | | | | cast | |

Cold End Feed
Fuel: Bunker C of 225 ppm V; 2.05% S and 0.085% Ash
Injection at: Economizer Outlet

TABLE III

Cold End Feed Combined With Injection of Additive To Fuel Oil Furnace Chamber
Fuel = Bunker C of 225 ppm V; 2.05% S & 0.085% Ash

| Addition of: Example | Agent of: | Injection Point | Sulfur Trioxide in Flue Gas (parts per million) | Acidity of Ash Deposits on Air Heater Outlet | Condition of Air Heaters | Appearance of Stack | Total lbs. of Additive (on dry basis) per 8,000 lbs. of fuel Equal to lbs. Additive/1,000 Gals. Fuel |
|---|---|---|---|---|---|---|---|
| 3 | MgO Powder "D" | Superheater Inlet | 40 | 3.5 | Slight Corrosion | Slight Grey Cast | 3.1 |
| 4 | (a) MgO Powder "D" Plus | Superheater Inlet | 28 | 4.0 | Minor Corrosion | Slight Grey Plume | 1.5 |
| | (b) MgO Powder "D" | Economizer Outlet | | | | | 1.6 |
| 5 | (a) MgO Slurry Plus | Fuel Oil | 21 | 4.4 | Good | Slight Grey-White Cast | 1.5 |
| | (b) MgO Powder "D" | Economizer Outlet | | | | | 2.5 |

Use of the synthetic blends of "hard" and "soft" MgO's gave a greater reduction in the plume opacity—i.e., from a slight blue plume for the commercial blend to a very light blue-grey cast that is just barely visible. Fine particles coming out of a plume refract light in such a way that the opacity of the plume is greater than obtained with particles that are somewhat coarser, as for example in the synthetic blend which has denser and heavier particles that do not refract as much light. The number of particles emitted from the stack using the synthetic blend was fewer than the total particles per unit of gas, or per unit of time, when comparing the synthetic versus the commercial blend.

Another significant improvement of the synthetic blend is in the deposits laid down on the air heater tubes. With the synthetic blend, they were light and fluffy, whereas with the commercial blend they are densely packed, and difficult to clean. This is due to the greater preponderance of the heavier, larger-sized particles of MgO in my synthetic blend so that the deposits that form do not pack but rather remain loose and in a "layered" structure. The "softer" the MgO, i.e., the finer the particle size, the more dense will be the deposit laid down.

The following Table IV illustrates a comparison between the results obtained with no addition of MgO, with addition of a synthetic blend D, and with the addition of soft and hard MgO's respectively.

TABLE IV

Comparison of Results
Treatment Rate: 3.1 lbs./8,000 lbs. of fuel
Fuel: Bunker C, 225 ppm V; 2.05% S and 0.085% Ash
Injection Point: Economizer Outlet

| Composition | Sulfur Trioxide in Flue Gas | Condition of Air heaters | Appearance of Stack |
|---|---|---|---|
| None | 60 | Badly Corroded | Distinct Blue Plume |
| "D" | 35 | Slight Corrosion | Slight Blue-Grey Cast |
| "Soft" | 30 | Heavily Plugged, with Increase in Air Heater Differential | Dense White Plume |
| "Hard" | 45 | Loose Powder Distinct Corrosion | Blue Plume |

Whereas the use of the very fine, "soft" MgO reduced the $SO_3$ from 60 to 30 ppm, it caused very heavy and bridged deposits on the air heaters with an increase in the air heater traverse, indicating plugging of the air heaters. The use of only the "hard" or dense MgO did not cause plugging, but it was less effective for neutralizing the $SO_3$. The reduction of the $SO_3$ was only from 60 to 45 ppm.

Use of the synthetic blend here disclosed is more cost effective than the use of any commercially available magnesium oxides in reducing corrosion of the air heaters. Not only is such corrosion undesirable in and of itself with respect to its effect on the furnace components, but it also results in more acidic particulates emanating from the stack because the corrosive products, such as iron oxide, produce their own effluent particulates. The synthetic blend of the present invention reduced the iron oxide content in the effluent particulates from 6.5% to less than 1% after an on-line treatment of several months.

Since the MgO blend must be added substantially continuously, it is important that the particles be readily flowable, and in this regard it has been found beneficial to add to the blend a flow improving agent. Appropriate flow improving agents are talc, ground expanded vermiculite, diatomaceous earth, synthetic calcium silicate, hydrous aluminum silicate, calcium metasilicate, ground mica to pass a 60 mesh, and other agents which generally have the characteristics of being dry powders with a density of 30–60 lb./ft.$^3$ and a mesh size of 60. The following Table V illustrates the use of different such agents.

TABLE V

| Blends to Improve the Flow Characteristics and the Effectiveness of the MgO | |
|---|---|
| Component | Percent |
| A. "Hard" MgO | 50 |
| "Soft" MgO | 25 |
| Talc (hydrous magnesium silicate) | 25 |
| Bulk density was 43 lbs./cu. ft. Mean particle size 8.6 microns. | |
| B. "Hard" MgO | 50 |
| "Soft" MgO | 25 |
| Sodium bicarbonate | 15 |
| Talc | 10 |
| Bulk density was 48 lbs./cu. ft. Mean particle size 8.4 microns. | |
| C. "Hard" MgO | 50 |
| "Soft" MgO | 25 |
| Sodium bicarbonate | 5 |
| Talc | 10 |
| Urea | 10 |
| Bulk density was 46 lbs./cu. ft. Mean particle size 8.4 microns. | |
| D. "Hard" MgO | 50 |
| "Soft" MgO | 25 |
| Ground "expanded vermiculite" to pass a 60 mesh, 95% or better | 25 |
| Bulk density was 40 lbs./cu. ft. Mean particle size 8.4 microns. | |
| E. "Hard" MgO | 50 |
| "Soft" MgO | 25 |
| Celite(R) diatomaceous earth | 25 |
| Bulk density was 38 lbs./cu. ft. Mean particle size 8.3 microns | |
| F. "Hard" MgO | 50 |
| "Soft" MgO | 25 |
| Micro-cel ® synthetic | 25 |
| calcium silicate | 25 |
| Bulk density was 39 lbs./cu. ft. Mean particle size 8.2 microns. | |

The use of sodium bicarbonate to the MgO is often beneficial for certain boilers where the air heaters are so designed that the flue gas does not flow directly through the air heater elements. The sodium bicarbonate accelerated the reaction time to obtain neutralization of the $SO_3$ as determined in a laboratory mock-up test where the MgO by itself took 55 seconds to neutralize an aliquot sample of sulfuric acid compared to 25 seconds for the blend of magnesium oxides (75%) and sodium bicarbonate (25%). Other fast-acting neutralizers can be added to the MgO instead of the sodium bicarbonate, examples of which are sodium carbonate, potassium carbonate or bicarbonate and calcium bicarbonate being of particular benefit.

The use of urea and other amine-containing compounds releases a gaseous, ammonia-type of neutralizing agent into the gas stream.

While the use of the magnesium oxide blends here disclosed as a cold end additive is efficacious in and of itself, and may in certain installations be all that is required, the overall advantageous effects can be enhanced by also adding magnesium to the portion of the furnace where combustion takes place. That magnesium may be in the form of the blend here disclosed or it may be in other forms, as in the form of slurry.

While there is no limit to the amount of MgO blend that one could add at the cold end, practical considerations demand that as little MgO as possible be used in order to reduce the treatment cost. Excessive amounts of magnesium oxide are further contraindicated because they could lead to deposit buildup on the air heaters and also increase the opacity of the stack plume. The effective and preferable ranges of the amounts of MgO added in relation to the amount of fuel, both for the case when MgO is added only at the cool end (economizer) and for the case when the MgO is added both at the point of combustion and in the cold end, are shown in the following Table VI. While these figures are set forth in terms of pounds of additive per 8,000 pounds of fuel oil, it should be understood that the nature of the fuel oil will have an effect on the optimum and required amounts of additive and that the use of other fuels will give rise to modified but comparable values for the amounts of additive.

TABLE VI

| | Boiler Location of Addition of MgO | Additive Feed Rates: Effective Range (lbs. per 8,000 lbs. of Fuel Oil) | Additive Feed Rates: Preferable Range (lbs. per 8,000 lbs. of Fuel Oil) |
|---|---|---|---|
| 1. | Economizer Outlet (only) | 1.0–20 | 2.5–15 |
| 2A. | Fuel Oil (Superheater Inlet - i.e., boiler box) PLUS | 1.0–6 | 2.5–5 |
| 2B. | Economizer Outlet | 0.75–12 | 2.5–7 |
| | Total MgO (per 8,000 lbs. fuel oil) - i.e., 2A + 2B | 1.75–18 | 5.0–12 |

It should be understood that while cold end addition has been here specifically described with respect to addition at the economizer, that is not essential, as is well known to those in the art.

Of course, there is nothing to prevent the use of lesser amounts of cold end additive than those set forth above in order to obtain some benefit from the method of the present invention, even though that benefit is not maximally obtained. Comparably, additional amounts of cold end additive may be used than those here set forth, although it is not believed that any additional benefit can be obtained thereby, except perhaps by way of a safety factor to compensate for variations in the sulfur content of the fuel, for inaccuracies in determining the magnitude of that sulfur content, or for changes which may occur in the combustion conditions which in turn may give rise to variations in the percentage conversion to $SO_3$. In other words, there is nothing critical in the amounts of magnesium-containing material employed for cold end feed, and in a given installation the determination of the optimal amount of additive to be used may well be arrived at empirically, by varying the amount of additive, analyzing the content of the stac gases, and selecting that amount of additive which gives the best results.

The cold end feed additive may be introduced into the system continuously or intermittently, depending upon economic and environmental needs and operating conditions to which the plant in question is subject, but in general it is preferred that the cold end addition occur continuously, since only in that way will the undesirable $SO_3$ emissions from the plant be fully minimized.

The additives used in accordance with the present invention may contain substances other than the magnesium-containing substances here specified, those other substances sometimes adding combustion control effects of their own and sometimes enhancing the effect of the magnesium here involved.

While this invention has been described in terms of the use of magnesium in the form of magnesium oxide, other magnesium compounds, and in particular magnesium hydroxide and compounds which under the conditions to which they are subjected in accordance with these teachings convert or decompose to magnesium oxide or magnesium hydroxide, may also be employed, and the term "magnesium compound" as here used encompasses all of such substances.

While only a limited number of embodiments of the present invention have been here specifically described, it will be apparent that many variations may be made therein, all without departing from the spirit of the invention as defined in the following claims.

I claim:

1. In the operation of a fuel burning system having a fuel burning furnace and means for conveying the products of combustion from the furnace to a low temperature area and then to exhaust, the improvement which comprises adding to said system a magnesium compound in the form of a blend of coarse and fine particles, said blend having a loosely packed bulk density of 35–67 lbs./cu.ft., said blend comprising said coarse and fine particles in a ratio by weight of 90/10–30/70.

2. The method of claim 1, in which said coarse particles have a mean particle size of about 10 microns and said fine particles have a mean particle size of about 5 microns.

3. The method of claim 1, in which the bulk density of said blend is about 45 lbs./cu.ft.

4. The method of claim 1, in which the ratio of coarse to fine particles is about 66/33.

5. The method of either of claims 1 or 2, in which said blend is added to said system at said low temperature area.

6. The method of claim 5, in which said blend is added at a rate of from 1.0–20 pounds per 8,000 pounds of fuel oil or its equivalent.

7. The method of claim 5, in which said blend is added at a rate of from 2.5–15 pounds per 8,000 pounds of fuel oil or its equivalent.

8. The method of either of claims 1 or 2, in which said fuel burning system includes an economizer and in which said blend is added to said system in the vicinity of said economizer.

9. The method of claim 8, in which said blend is added at a rate of from 1.0–20 pounds per 8,000 pounds of fuel oil or its equivalent.

10. The method of claim 8, in which said blend is added at a rate of from 2.5–15 pounds per 8,000 pounds of fuel oil or its equivalent.

11. The method of claim 5, in which a magnesium compound is also added to the furnace of said fuel burning system.

12. The method of claim 11, in which said magnesium compound added to said low temperature area is at the rate of 0.75–12 pounds per 8,000 pounds of fuel oil or its equivalent.

13. The method of claim 11, in which a magnesium compound is added to said furnace area at the rate of 1.06–6 pounds per 8,000 pounds of fuel oil or its equivalent.

14. The method of claim 12, in which a magnesium compound is added to said furnace area at the rate of 1.06–6 pounds per 8,000 pounds of fuel oil or its equivalent.

15. The method of claim 11, in which a magnesium compound is added to said furnace area at the rate of 2.5–5 pounds per 8,000 pounds of fuel oil or its equivalent.

16. The method of claim 11, in which said blend is added to said low temperature area at the rate of 2.5–7 pounds per 8,000 pounds of fuel oil or its equivalent, and a magnesium compound is added to said furnace area at the rate of 2.5–5 pounds per 8,000 pounds of fuel oil or its equivalent.

17. The method of claim 5, in which said blend also comprises a flow-improving agent from the group consisting of talc, ground expanded vermiculite, hydrous aluminum silicate, diatomaceous silica, calcium metasilicate, ground mica, diatomaceous earth and synthetic calcium silicate.

18. The method of claim 5, in which said blend also comprises a neutralizing agent from the group consisting of sodium bicarbonate, sodium carbonate, potassium bicarbonate, potassium carbonate, calcium bicarbonate, urea and other amine-containing compounds.

* * * * *